United States Patent [19]

Allardyce

[11] Patent Number: 4,604,072

[45] Date of Patent: Aug. 5, 1986

[54] METHOD FOR ENGAGING SUPPORT STUDS INTO SHADOW MASK SPRING APPARATUS

[75] Inventor: Gerald M. Allardyce, Avoca, Pa.

[73] Assignee: RCA Corporation, Princeton, N.J.

[21] Appl. No.: 627,534

[22] Filed: Jul. 3, 1984

[51] Int. Cl.[4] ..... H01J 29/07

[52] U.S. Cl. ..... 445/30; 313/406

[58] Field of Search ..... 445/30, 68; 313/403, 313/404, 405, 406

[56] References Cited

U.S. PATENT DOCUMENTS

| | | | |
|---|---|---|---|
| 3,449,611 | 6/1969 | Schwartz et al. | 313/405 |
| 4,138,774 | 2/1979 | Oyama | 445/68 |
| 4,164,060 | 8/1979 | Hartta | 445/30 |
| 4,451,243 | 5/1984 | D'Augustine | 445/68 |
| 4,467,242 | 8/1984 | Wilbur, Jr. et al. | 445/406 |

FOREIGN PATENT DOCUMENTS 6801741 8/1968 Netherlands .

*Primary Examiner*—Kenneth J. Ramsey
*Attorney, Agent, or Firm*—E. M. Whitacre; D. H. Irlbeck; T. H. Magee

[57] ABSTRACT

A CRT has a spring for mounting the shadow mask assembly of the CRT onto a stud of the CRT panel. The spring has a circular flange contered on a stud receiving hole. Thus the stud hole is always straight up and at a fixed distance from a locator of an insertion machine regardless of any tilt of the spring, and therefore the shadow mask assembly is always correctly inserted into the panel.

1 Claim, 7 Drawing Figures

METHOD FOR ENGAGING SUPPORT STUDS INTO SHADOW MASK SPRING APPARATUS

BACKGROUND OF THE INVENTION

The present invention relates to a CRT (cathode ray tube), and more particularly to a CRT having improved springs that are used to secure a shadow mask assembly to a CRT panel.

A conventional color CRT has a shadow mask having circular or slit-shaped apertures for color selection purposes. In the fabrication of the CRT, a frame is welded to clips, which clips are usually bimetallic in order to maintain registration between the mask and a phosphor pattern on a panel with temperature changes. The shadow mask is then welded to the frame, resulting in a shadow mask assembly. A spacer is then placed behind the CRT panel and then the assembly is placed behind the spacer. Springs, having stud receiving holes, are then placed on studs that are disposed on the four sides of the panel and the springs welded to the clips. The spacer is then removed. It will be seen that various manufacturing tolerances are involved, in particular, mask-to-frame, frame-to-clip, and clip-to-spring tolerances. All of the tolerances involved allow a large tolerance error build up to occur.

The panel then goes through various steps of matrixing, screening, and aluminizing, which steps involve about five insertions and four removals of the shadow mask assembly from the panel. The insertion is done by a machine called a "mask inserter" such as shown in U.S. Pat. No. 4,451,243 and under common assignment herewith, and the removal is done by a "mask remover". However, due to said tolerance errors, accurate location of the stud holes may not take place, and therefore improper insertion (less than all four springs receiving a stud) occurs resulting in misregistration of the shadow mask with respect to the panel. The improper insertion is detected and the CRT production line is stopped. Thus a loss of production is the result.

SUMMARY OF THE INVENTION

The present invention overcomes the above problem of improper insertion. A CRT in accordance with the invention includes a spring having a flange with an arcuate circular edge centered on a stud receiving hole. A method in accordance with the invention comprises engaging the flange with a concave top surface of a locator of an insertion machine, which results in accurate location of the stud hole, and hence accurate insertion of the assembly into the panel.

DETAILED DESCRIPTION

Figure 1:
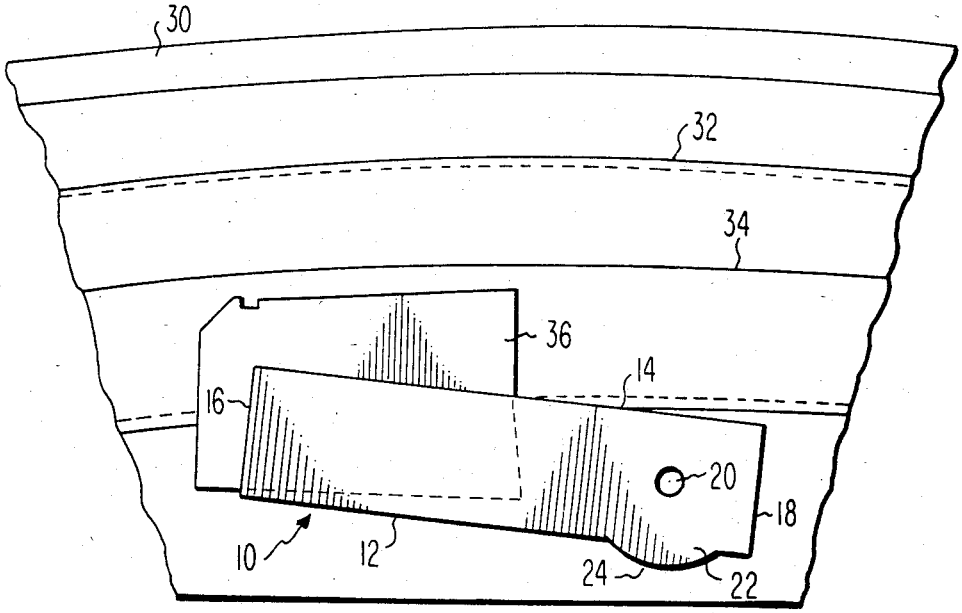
FIG. 1 shows a side view of a portion of a CRT in accordance with the invention.

FIG. 1 shows a portion of a CRT viewed from the outside with a skirt of a panel 30 removed. Behind the panel 30 is a color selection electrode or shadow mask 32 which is welded to a frame 34. A clip 36 also is welded to the frame 34. A generally rectangular steel spring 10, having longitudinal sides 12 and 14 and ends 16 and 18, is welded to the clip 36 at its end 16. The spring 10 is shown tilted relative to the frame 34. There are four such springs and clips disposed on the four sides of the frame. A hole 20 is located near the end 18 for receiving a stud (not shown) that is on the inside of the panel 30. There is one such stud on each side of the skirt of the panel 30. The spring 10 includes a flange 22 that extends beyond the longitudinal side 12. In particular, the flange 22 comprises a circular arcuate edge 24 with the center of the hole 20 being the center of curvature of the edge 24. Thus all points along the edge 24 are at an equal distance from the center of the hole 20.

Figure 2A:
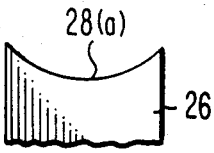
FIGS. 2(*a*), (*b*), and (*c*) show side views of three variations of locators that can be used with the invention.
Figure 2B:
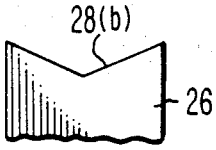
Figure 2C:
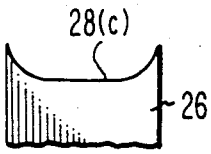

FIGS. 2(*a*), (*b*) and (*c*) show three embodiments of locators 26. All of the locators 26 have concave top surfaces 28, although of different shapes. FIG. 2(*a*) shows a circular top surface 28(*a*), FIG. 2(*b*) shows a V-shaped top surface 28(*b*), and FIG. 2(*c*) shows a bowl-shaped top surface 28(*c*). The V-shaped top surface 28(*b*) is the preferred embodiment since it locates the hole 20 both vertically and horizontally.

Figure 3A:
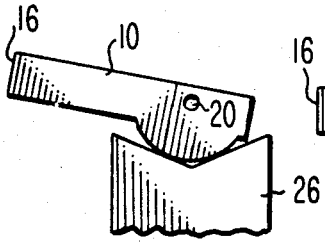
FIGS. 3(*a*), (*b*) and (*c*) shown a locator engaging a spring of the CRT.
Figure 3B:
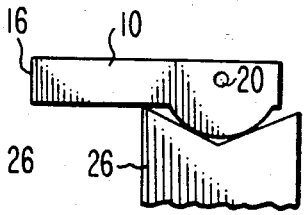
Figure 3C:
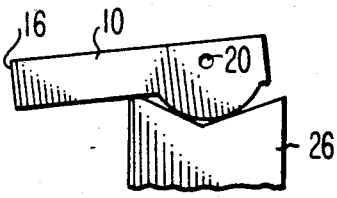

A mask insertor has either three or four of the locators 26. In operation, the locators 26 are raised until the surfaces 28 respectively engage the edges 24 of the springs 10. FIGS. 3(*a*), (*b*), and (*c*) show the results of the locator 26 engaging the edge 24 for three different situations of tilt of the spring 10 due to either possible tolerance errors or design variations. FIG. 3(*a*) shows the situation when the end 16 is tilted up, FIG. 3(*b*) shows the situation when there is not tilt, i.e. there are not tolerance errors, and FIG. 3(*c*) shows the situation when the end 16 is tilted down. It will be seen that in all cases, the hole 20 is always the same distance directly above the center of the surface 28 because the edge 24 is a portion of a circle. Thus, the upward motion of the locators 26 can continue with assurance that the holes 20 will correctly receive the respective studs, which are located relative to the locators 26 by other means. Thus the mask assembly is placed into the panel without registration errors.

It will be appreciated that other embodiments within the spirit and scope of the invention are possible. In particular, the flange 22 can be made so that it does not extend beyond the side 12, i.e. the intersection of the edge 24 and the side 12 is a cusp. Also the clip 36 and the spring 10 can be formed as a single bimetallic element, as known in the art.

What is claimed is:

1. A method for placing a shadow mask assembly into a CRT panel having studs, said method comprising:

engaging a circualr arcuate edge of a shadow mask spring having a stud receiving hole at the center of curvature of said edge with a locator having a concave top surface; and moving said locator to thereby move said panel assembly until said spring hole receives a stud.

* * * * *